US011538413B1

(12) United States Patent
Kim et al.

(10) Patent No.: US 11,538,413 B1
(45) Date of Patent: Dec. 27, 2022

(54) PIXEL AND DISPLAY APPARATUS INCLUDING THE SAME

(71) Applicant: SAMSUNG DISPLAY CO., LTD., Yongin-si (KR)

(72) Inventors: Keunwoo Kim, Yongin-si (KR); Meejae Kang, Yongin-si (KR); Dokyeong Lee, Yongin-si (KR); Taewook Kang, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/701,935

(22) Filed: Mar. 23, 2022

(30) Foreign Application Priority Data

Jun. 10, 2021 (KR) ..... 10-2021-0075487

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC .. G09G 3/3688; G09G 3/3648; G09G 3/3233; G09G 2300/0819; G09G 2300/0852; G09G 2300/0842; G09G 2310/027; G09G 2320/0233; G09G 2320/043; G09G 2320/0252
See application file for complete search history.

(56) References Cited

U.S. PATENT DOCUMENTS

| | | | | |
|---|---|---|---|---|
| 10,255,855 | B2 | 4/2019 | Park et al. | |
| 10,943,965 | B2 | 3/2021 | Cho et al. | |
| 2014/0062331 | A1* | 3/2014 | Nam | G09G 3/3233 315/226 |
| 2021/0280652 | A1 | 9/2021 | Kim et al. | |

FOREIGN PATENT DOCUMENTS

| | | | |
|---|---|---|---|
| CN | 113363290 | A | 9/2021 |
| KR | 1020170049787 | A | 5/2017 |
| KR | 101794648 | B1 | 11/2017 |
| KR | 1020200009171 | A | 1/2020 |
| KR | 1020210113513 | A | 9/2021 |

OTHER PUBLICATIONS

Synopsys, PrimeSim SPICE, 2021, 2pages, https://www.synopsys.com/verification/ams-verification/finesim.html.

* cited by examiner

*Primary Examiner* — Dong Hui Liang
(74) *Attorney, Agent, or Firm* — Cantor Colburn LLP

(57) ABSTRACT

A pixel includes a display element, a driving transistor which controls an amount of a driving current flowing toward the display element, a first capacitor connected to a gate of the driving transistor, a scan transistor which transfers a data voltage to a source of the driving transistor, first and second compensation transistors connected to each other in series between the gate and a drain of the driving transistor, first and second emission control transistors which generates a path of the driving current between the display element and a power line, and a second capacitor connected between a floating node between the first and second compensation transistors and a gate of the second emission control transistor.

20 Claims, 6 Drawing Sheets

PIXEL AND DISPLAY APPARATUS INCLUDING THE SAME

This application claims priority to Korean Patent Application No. 10-2021-0075487, filed on Jun. 10, 2021, and all the benefits accruing therefrom under 35 U.S.C. § 119, the content of which in its entirety is herein incorporated by reference.

BACKGROUND

1. Field

Embodiments relate to pixels and display apparatuses including the same.

2. Description of the Related Art

Organic light-emitting display apparatuses include display elements having luminance that varies with a current, for example, organic light-emitting diodes. A pixel of an organic light-emitting display apparatus includes a display element, a driving transistor which controls an amount of a current supplied to the display element according to a voltage between a gate and a source, and a switching transistor which transfers (or delivers), to the driving transistor, a data voltage to control the luminance of the display element.

To maintain the luminance of the display element constant for one frame, the voltage between the gate and the source of the driving transistor needs to be maintained constant. To this end, the pixel further includes a storage capacitor connected to the gate of the driving transistor.

SUMMARY

In order to display more vivid images, a resolution of the organic light-emitting display apparatus has been gradually increased and a size of a pixel has been gradually decreased. To reduce the size of the pixel, a capacity of a storage capacitor is decreased. Accordingly, a luminance of a display element varies as a gate voltage of a driving transistor is changed even by a small leakage current.

In addition, in order to reduce power consumption in an organic light-emitting display apparatus or an electronic device connected thereto, a technology for driving at a low frame rate is applied depending on a situation. In this case, one frame period becomes longer, and changes in the luminance of the display element are more visible to a user.

Embodiments include pixels in which a turn-off current of a switching transistor connected to a storage capacitor is reduced, and display apparatuses including the pixels.

The technical features to be achieved by the invention are not limited to the above-described features, and other technical features that are not mentioned herein would be clearly understood by a person skilled in the art from the description of the invention.

Additional features will be set forth in part in the description which follows and, in part, will be apparent from the description, or may be learned by practice of the presented embodiments of the invention.

In an embodiment of the invention, a pixel includes a display element, a driving transistor which controls an amount of a driving current flowing toward the display element according to a gate-source voltage of the driving transistor, a first capacitor connected to a gate of the driving transistor, a scan transistor which transfers a data voltage to a source of the driving transistor in response to a first scan signal, first and second compensation transistors which operate in response to a first scan signal, and which are connected to each other in series between the gate and a drain of the driving transistor, first and second emission control transistors which generate, in response to an emission control signal, a path of the driving current between the display element and a power line which transfers a driving voltage, and a second capacitor connected between a floating node between the first and second compensation transistors and a gate of the second emission control transistor.

In an embodiment, the first and second compensation transistors may be turned off in response to a rising edge of the first scan signal, the first and second emission control transistors may be turned on in response to a falling edge of the emission control signal, and a first potential change amount of the floating node in response to the rising edge of the first scan signal may be at least partially offset by a second potential change amount of the floating node in response to the falling edge of the emission control signal.

In an embodiment, the first and second compensation transistors may be turned off in response to a rising edge of the first scan signal, the first and second emission control transistors may be turned on in response to a falling edge of the emission control signal, and an potential of the floating node may rise by the rising edge of the first scan signal, and fall by the falling edge of the emission control signal.

In an embodiment, the first emission control transistor may connect, in response to the emission control signal, the power line to the source of the driving transistor, the second emission control transistor may connect, in response to the emission control signal, the drain of the driving transistor to an anode of the display element.

In an embodiment, the first capacitor may be connected between the power line and the gate of the driving transistor.

In an embodiment, the pixel may further include a semiconductor layer, a first scan line which is arranged on the semiconductor layer and transfers the first scan signal, the first scan line including first and second gate electrodes and each of the first and second gate electrodes at least partially overlapping the semiconductor layer, an emission control line which is arranged on the semiconductor layer and transfers the emission control signal, the emission control line including a third gate electrode that at least partially overlaps the semiconductor layer, a conductive pattern arranged between the first and second gate electrodes, and at least partially overlapping the semiconductor layer, and a connection pattern arranged on the conductive pattern, and connecting the conductive pattern to the third gate electrode.

In an embodiment, the semiconductor layer may include a semiconductor area at least partially overlapping the first to third gate electrodes, and a conductive area at least partially overlapping the conductive pattern.

In an embodiment, the second capacitor may include the conductive pattern and the conductive area of the semiconductor layer.

In an embodiment, the pixel may further include a gate initialization transistor which applies, in response to a second scan signal, an initialization voltage to the gate of the driving transistor.

In an embodiment, the gate initialization transistor may include first and second gate initialization transistors connected to each other in series between a voltage line which transfers the initialization voltage and the gate of the driving transistor.

In an embodiment, in one frame period, after the gate initialization transistor is turned on in response to the second scan signal having a pulse voltage of a turn-on level, the scan transistor and the first and second compensation transistors may be turned on in response to the first scan signal having a pulse voltage of a turn-on level.

In an embodiment, the pixel may further include an anode initialization transistor which applies, in response to a third scan signal, an initialization voltage to an anode of the display element.

In an embodiment, the third scan signal may be synchronized with the first scan signal.

In another embodiment of the invention, in a pixel connected to first to third scan lines which transfer first to third scan signals, respectively, an emission control line which transfers an emission control signal, a data line which transfers a data voltage, a power line which transfers a driving voltage, and a voltage line which transfers an initialization voltage, the pixel includes a display element including an anode and a cathode, a first capacitor including a first electrode and a second electrode, the first electrode being connected to the power line, a first transistor including a gate connected to the second electrode of the first capacitor, a source connected to the power line, and a drain, a second transistor including a gate connected to the first scan line, a source connected to the data line, and a drain connected to the source of the first transistor, a third transistor including a first compensation transistor and a second compensation transistor, the first compensation transistor including a gate connected to the first scan line, a source connected to a floating node, and a drain connected to the gate of the first transistor, and the second compensation transistor including a gate connected to the first scan line, a source connected to the drain of the first transistor, and a drain connected to the floating node, a second capacitor including a third electrode connected to the floating node and a fourth electrode connected to the emission control line, a fourth transistor including a gate connected to the second scan line, a source connected to the gate of the first transistor, and a drain connected to the voltage line, a fifth transistor including a gate connected to the emission control line, a source connected to the power line, and a drain connected to the source of the first transistor, a sixth transistor including a gate connected to the emission control line, a source connected to the drain of the first transistor, and a drain connected to the anode of the display element, and a seventh transistor including a gate connected to the third scan line, a source connected to the anode of the display element, and a drain connected to the voltage line.

In an embodiment, the third transistor may be turned off in response to a rising edge of the first scan signal, the fifth and sixth transistors may be turned on in response to a falling edge of the emission control signal, and a first potential change amount of the floating node in response to the rising edge of the first scan signal may be at least partially offset by a second potential change amount of the floating node in response to the falling edge of the emission control signal.

In an embodiment, the third transistor may be turned off in response to a rising edge of the first scan signal, the fifth and sixth transistors may be turned on in response to a falling edge of the emission control signal, and an potential of the floating node may rise by the rising edge of the first scan signal, and fall by the falling edge of the emission control signal.

In an embodiment, the fourth transistor may include a first gate initialization transistor and a second gate initialization transistor, the first gate initialization transistor including a gate connected to the second scan line, a source connected to the gate of the first transistor, and a drain, and the second gate initialization transistor including a gate connected to the second scan line, a source connected to the drain of the first gate initialization transistor, and a drain connected to the voltage line.

In another embodiment of the invention, a display apparatus includes a substrate extending in a first direction and a second direction, first and second scan lines which transfer first and second scan signals, respectively, and extend in the first direction, a data line which transfers a data voltage and extending in the second direction, an emission control line which transfers an emission control signal, a power line which transfers a driving voltage, and a plurality of pixels arranged on the substrate in the first direction and the second direction. Each of the plurality of pixels includes a display element, a driving transistor which controls an amount of a driving current flowing toward the display element according to a gate-source voltage of the driving transistor, a first capacitor connected to a gate of the driving transistor, a scan transistor which transfers a data voltage to a source of the driving transistor in response to the first scan signal, first and second compensation transistors which operate in response to the first scan signal, and which are connected to each other in series between the gate and a drain of the driving transistor, first and second emission control transistors which generate, in response to the emission control signal, a path of the driving current between the display element and the power line, and a second capacitor connected between a floating node between the first and second compensation transistors and a gate of the second emission control transistor.

In an embodiment, the first and second compensation transistors may be turned off in response to a rising edge of the first scan signal, the first and second emission control transistors may be turned on in response to a falling edge of the emission control signal, and a first potential change amount of the floating node in response to the rising edge of the first scan signal may be at least partially offset by a second potential change amount of the floating node in response to the falling edge of the emission control signal.

In an embodiment, the first and second compensation transistors may be turned off in response to a rising edge of the first scan signal, the first and second emission control transistors may be turned on in response to a falling edge of the emission control signal, and an potential of the floating node may rise by the rising edge of the first scan signal, and fall by the falling edge of the emission control signal.

Other features, features, and advantages than those described above will become apparent from the following drawings, claims, and detailed description of the invention.

These general and predetermined features may be embodied using a system, a method, a computer program, or any combination of a system, a method, and a computer program.

BRIEF DESCRIPTION OF THE DRAWINGS

The above and other features and advantages of certain embodiments of the invention will be more apparent from the following description taken in conjunction with the accompanying drawings, in which.

DETAILED DESCRIPTION

Figure 1:
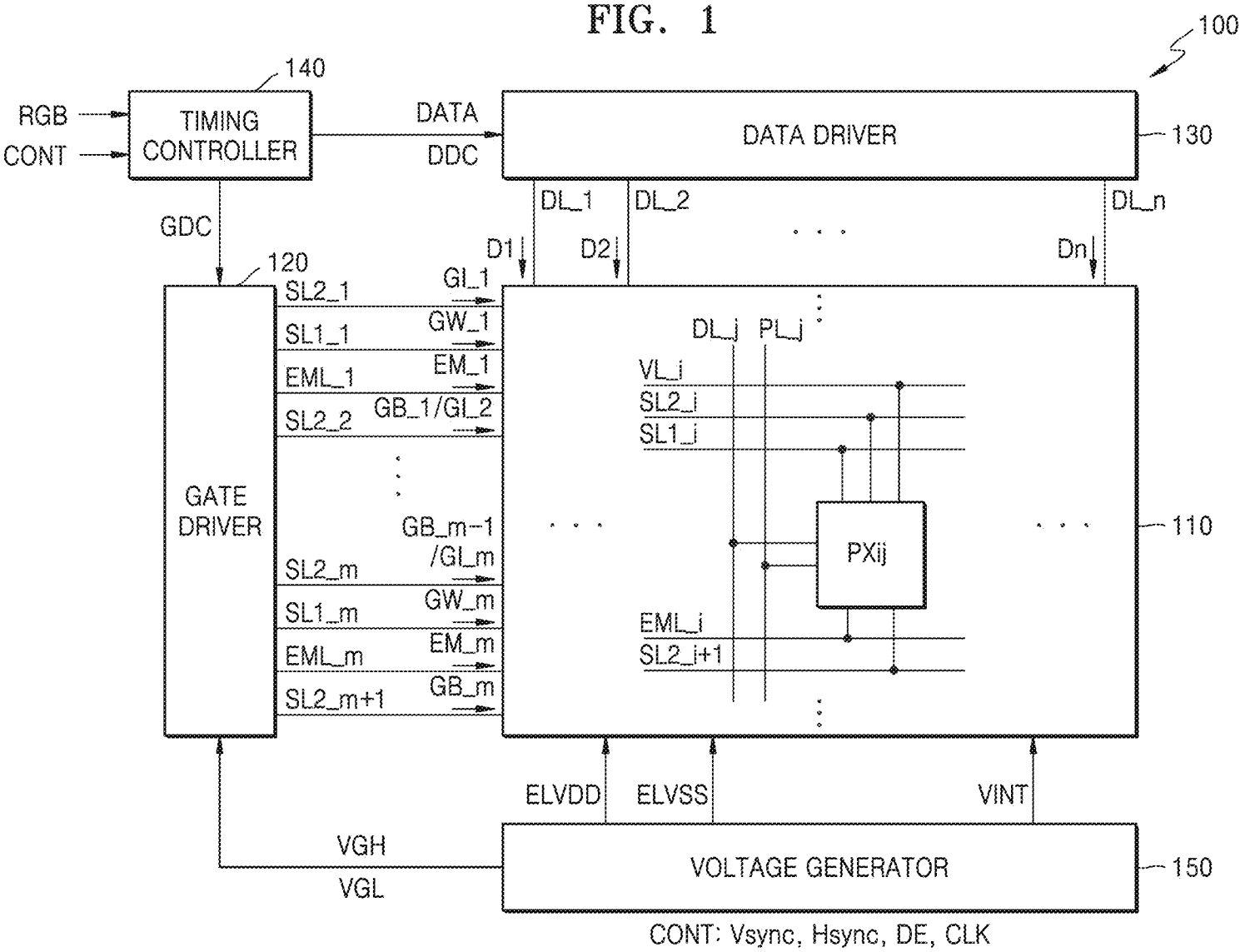
FIG. 1 is a schematic block diagram of an embodiment of an organic light-emitting display apparatus.

Reference will now be made in detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are merely described below, by referring to the drawing figures, to explain features of the description. As used herein, the term "and/or" includes any and all combinations of one or more of the associated listed items. Throughout the disclosure, the expression "at least one of a, b or c" indicates only a, only b, only c, both a and b, both a and c, both b and c, all of a, b, and c, or variations thereof.

Various modifications may be applied to the embodiments, and particular embodiments will be illustrated in the drawings and described in the detailed description section. The effect and features of the embodiments, and a method to achieve the same, will be clearer referring to the detailed descriptions below with the drawings. However, the embodiments may be implemented in various forms, not by being limited to the embodiments presented below.

Embodiments will now be described more fully with reference to the accompanying drawings, and like reference numerals in the drawings denote like elements, and thus their description will be omitted.

While such terms as "first," "second," etc., may be used to describe various components, such components must not be limited to the above terms. The above terms are used only to distinguish one component from another.

In embodiments below, an expression used in the singular encompasses the expression of the plural, unless it has a clearly different meaning in the context.

In embodiments below, it is to be understood that the terms such as "including," "having," and "comprising" are intended to indicate the existence of features or constituent element disclosed in the specification, and are not intended to preclude the possibility that one or more other features or constituent element may exist or may be added.

In embodiments below, it will be understood that when a layer, region, or component is referred to as being "formed on" another layer, region, or component, it can be directly or indirectly formed on the other layer, region, or component. That is, for example, intervening layers, regions, or components may be present.

Sizes of components in the drawings may be exaggerated for convenience of explanation. Since amounts and thicknesses of components in the drawings, for example, are arbitrarily illustrated for convenience of explanation, the following embodiments are not limited thereto.

When a certain embodiment may be implemented differently, a specific process order may be performed differently from the described order. Two consecutively described processes, for example, may be performed substantially at the same time or performed in an order opposite to the described order.

In the specification, the expression such as "A and/or B" may include A, B, or A and B. The expression such as "at least one of A and B" may include A, B, or A and B.

In embodiments below, it will be understood that when a layer, region, or component is referred to as being "connected to" another layer, region, or component, it can be directly connected to the other layer, region, or component or indirectly connected to the other layer, region, or component via intervening layers, regions, or components. In the specification, when a layer, region, or component is also referred to as being electrically connected to another layer, region, or component, it may be directly electrically connected to the other layer, region, or component or indirectly electrically connected to the other layer, region, or component via intervening layers, regions, or components, for example.

The x-axis, the y-axis and the z-axis are not limited to three axes of the quadrangular (e.g., rectangular) coordinate system, and may be interpreted in a broader sense. In an embodiment, the x-axis, the y-axis, and the z-axis may be perpendicular to one another, or may represent different directions that are not perpendicular to one another, for example.

FIG. 1 is a schematic block diagram of an embodiment of an organic light-emitting display apparatus 100.

Referring to FIG. 1, the organic light-emitting display apparatus 100 may include a display panel 110, a gate driver 120, a data driver 130, a timing controller 140, and a voltage generator 150.

The display panel 110 may include pixels PX such as a pixel PXij disposed in the i-th row and the j-th column. For easy understanding, although FIG. 1 illustrates only one pixel PXij, (m×n) pixels PX may be arranged, for example, in a matrix form. Here, m and n denote natural numbers greater than 1, i denotes a natural number of 1 or more and m or less, and j denotes a natural number of 1 or more and n or less.

Figure 2:
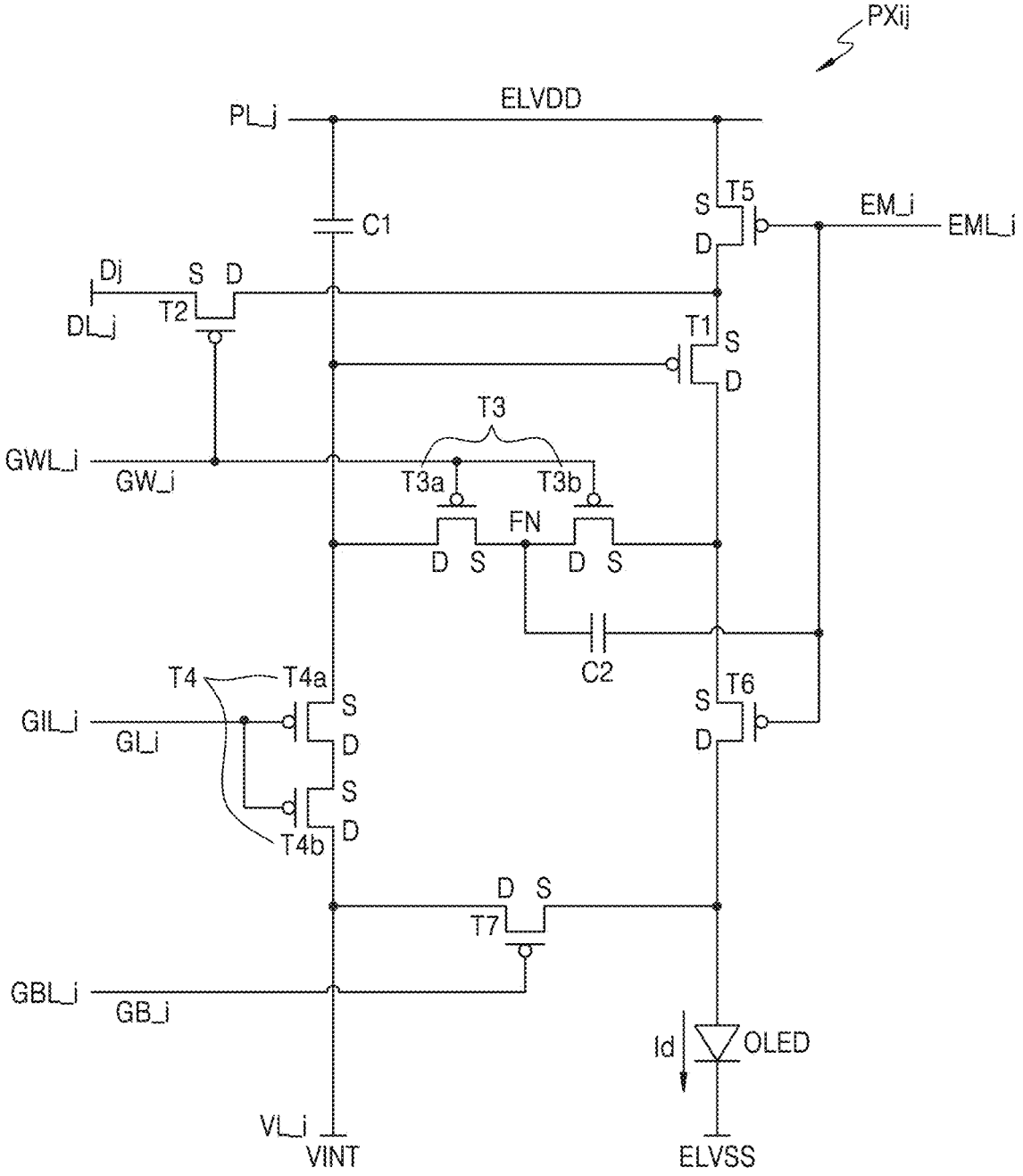
FIG. 2 is a schematic circuit diagram of an embodiment of a pixel circuit.

The pixels PX are connected to first scan lines SL1_1 to SL1_*m*, second scan lines SL2_1 to SL2_*m*+1, emission control lines EML_1 to EML_m, and data lines DL_1 to DL_n. The pixels PX are connected to power lines PL_1 to PL_n and voltage lines VL_1 to VL_m. In an embodiment, as illustrated in FIG. 2, the pixel PXij may be connected to a first scan line SL1_*i*, a second scan line SL2_*i*, an emission control line EML_i, a data line DL_j, a power line PL_j, a voltage line VL_i, and a second scan line SL2_*i*+1, for example. The second scan line SL2_*i*+1 may be also referred to as a third scan line with respect to the pixel PXij.

The first scan lines SL1_1 to SL1_*m*, the second scan lines SL2_1 to SL2_*m*+1, the emission control lines EML_1 to EML_m, and the voltage lines VL_1 to VL_m may extend in a first direction, for example, in a row direction, and may be connected to the pixels PX disposed in the same row. The data lines DL_1 to DL_n and the power lines PL_1 to PL_n may extend in a second direction, for example, in a column direction, and may be connected to the pixels PX disposed in the same column.

The first scan lines SL1_1 to SL1_*m* respectively transfer first scan signals GW_1 to GW_m output from the gate driver 120 to the pixels PX disposed in the same row, the second scan lines SL2_1 to SL2_*m* respectively transfer second scan signals GI_1 to GI_m output from the gate driver 120 to the pixels PX disposed in the same row, the second scan lines SL2_2 to SL2_*m*+1 respectively transfer third scan signals GB_1 to GB_m output from the gate driver 120 to the pixels PX disposed in the same row. A second scan signal GI_i and a third scan signal GB_i−1 may both be transferred through the second scan line SL2_*i*, and may actually be the same signal.

The emission control lines EML_1 to EML_m respectively transfer emission control signals EM_1 to EM_m output from the gate driver 120 to the pixels PX disposed in the same row. The data lines DL_1 to DL_n respectively transfer data voltages D1 to Dn output from the data driver 130 to the pixels PX disposed in the same column. The pixel PXij receives first to third scan signals GW_i, GI_i, and GB_i, a data voltage Dj, and an emission control signal EM_i.

Each of the power lines PL_1 to PL_n transfers a first driving voltage ELVDD output from the voltage generator 150 to the pixels PX disposed in the same column. Each of the voltage lines VL_1 to VL_m transfers an initialization voltage VINT output from the voltage generator 150 to the pixels PX disposed in the same row.

The pixel PXij may include a display element, and a driving transistor to control an amount of a driving current flowing to the display element based on the data voltage Dj. The data voltage Dj is output from the data driver 130 and received by the pixel PXij through the data line DL_j. The display element may include, for example, an organic light-emitting diode. As the display element emits light with a brightness corresponding to an amount of a driving current received from the driving transistor, the pixel PXij may express a gradation corresponding to the data voltage Dj.

One of the pixels PX may correspond to a part of a unit pixel capable of expressing a full color, for example, a sub-pixel. The pixel PXij may further include at least one switching transistor and at least one capacitor. The pixel PXij is described below in detail with reference to FIGS. 2 and 3.

The voltage generator 150 may generate voltages needed for driving the pixel PXij. In an embodiment, the voltage generator 150 may generate the first driving voltage ELVDD, a second driving voltage ELVSS, and the initialization voltage VINT, for example. The level of the first driving voltage ELVDD may be higher than the level of the second driving voltage ELVSS. The level of the initialization voltage VINT may be higher than the level of the second driving voltage ELVSS. A difference in level between the initialization voltage VINT and the second driving voltage ELVSS may be less than a threshold voltage needed for the display element of one of the pixels PX to emit light.

In an embodiment, the voltage generator 150 may generate a first gate voltage VGH and a second gate voltage VGL to control the switching transistor of the pixel PXij, and provide the generated first and second gate voltages VGH and VGL to the gate driver 120. When the first gate voltage VGH is applied to a gate of the switching transistor, the switching transistor may be turned off, and when the second gate voltage VGL is applied to the gate of the switching transistor, the switching transistor may be turned on. The first gate voltage VGH may be also referred to as the gate-off voltage, and the second gate voltage VGL may be also referred to as the gate-on voltage. The switching transistors of the pixel PXij may be p-type metal-oxide-semiconductor field-effect transistors ("MOSFETs"), and the level of the first gate voltage VGH may be higher than the level of the second gate voltage VGL. Although not illustrated in FIG. 1, in an embodiment, the voltage generator 150 may generate gamma reference voltages and provide the generated gamma reference voltages to the data driver 130.

The timing controller 140 may control the display panel 110 by controlling the operation timing of the gate driver 120 and the data driver 130. The pixels PX of the display panel 110 may receive new data voltages D1-Dn for each new frame period, and display an image corresponding to image source data RGB of one frame by emitting light with luminance corresponding to the data voltages D1-Dn.

In an embodiment, one frame period may include a gate initialization period, a data write and anode initialization period, and a light-emitting period. In the initialization period, in synchronism with a second scan signal GI, the initialization voltage VINT may be applied to the pixels PX. In the data write and anode initialization period, in synchronism with a first scan signal GW, the data voltages D1-Dn may be provided to the pixels PX and in synchronism with a third scan signal GB, the initialization voltage VINT may be applied to the pixels PX. In the light-emitting period, the pixels PX of the display panel 110 may emit light.

The timing controller 140 may receive the image source data RGB and a control signal CONT from the outside. The timing controller 140 may convert the image source data RGB to image data DATA based on the properties of the display panel 110 and the pixels PX, or the like. The timing controller 140 may provide the image data DATA to the data driver 130.

The control signal CONT may include at least one of a vertical synchronization signal Vsync, a horizontal synchronization signal Hsync, a data enable signal DE, or a clock signal CLK. The timing controller 140 may control the operation timing of the gate driver 120 and the data driver 130 by the control signal CONT.

The timing controller 140 may determine a frame period by counting the data enable signal DE of one horizontal scanning period 1H. In this case, the vertical synchronization signal Vsync and the horizontal synchronization signal Hsync, which are provided from the outside, may be omitted. The image source data RGB may include luminance information of the pixels PX. In an embodiment, the luminance may have a predetermined number, e.g., 1024 ($=2^{10}$), 256 ($=2^{8}$), or 64 ($=2^{6}$), of gradations (gray).

The timing controller 140 may generate a gate timing control signal GDC to control the operation timing of the gate driver 120, and a data timing control signal DDC to control the operation timing of the data driver 130.

The gate timing control signal GDC may include a gate start pulse ("GSP") signal, a gate shift clock ("GSC") signal, a gate output enable ("GOE") signal, or the like. The GSP signal is supplied to the gate driver 120 that generates a first scan signal at a start time of a scanning period. The GSC signal is a clock signal commonly input to the gate driver 120 to shift the GSP signal. The GOE signal controls an output of the gate driver 120.

The data timing control signal DDC may include a source start pulse ("SSP") signal, a source sampling clock ("SSC") signal, a source output enable ("SOE") signal, or the like. The SSP signal controls a data sampling start time of the data driver 130, and is provided to the data driver 130 at the start time of the scanning period. The SSC signal is a clock signal to control a data sampling operation in the data driver 130 at a rising or falling edge. The SOE signal controls an output of the data driver 130. The SSP signal supplied to the data driver 130 may be omitted depending on a data transmission method.

The gate driver 120 sequentially generates the first scan signals GW_1 to GW_m, the second scan signals GI_1 to GI_m, and the third scan signals GB_1 to GB_m, in response to the gate timing control signal GDC supplied by the timing controller 140, using the first and second gate voltages VGH and VGL provided by the voltage generator 150.

The data driver 130, in response to the data timing control signal DDC supplied by the timing controller 140, samples and latches the image data DATA supplied by the timing controller 140 and converts the image data into data in a parallel data system. When converting the data to the data in a parallel data system, the data driver 130 convert the image data DATA to a gamma reference voltage, that is, an analog type data voltage. The data driver 130 provides the data voltages D1 to Dn to the pixels PX through the data lines DL_1 to DL_n. The pixels PX receive the data voltages D1 to Dn in response to the first scan signals GW_1 to GW_m.

FIG. 2 is a schematic circuit diagram of an embodiment of a pixel circuit.

Referring to FIG. 2, the pixel PXij is connected to first to third scan lines GWL_i, GIL_i, and GBL_i which transfer the first to third scan signals GW_i, GI_i, and GB_i, respectively, the data line DL_j which transfers the data voltage Dj, and the emission control line EML_i which transfers the emission control signal EM_i. The pixel PXij is connected to the power line PL_j which transfers the first driving voltage ELVDD and the voltage line VL_i which transfers the initialization voltage VINT. The pixel PXij is connected to a common electrode to which the second driving voltage ELVSS is applied. The pixel PXij may correspond to the pixel PXij of FIG. 1.

The first scan line GWL_i corresponds to the first scan line SL1_*i* of FIG. 1, the second scan line GIL_i corresponds to the second scan line SL2_*i* of FIG. 1, and the third scan line GBL_i corresponds to the second scan line SL2_*i*+1 of FIG. 1.

The pixel PXij may include a display element OLED, first to seventh transistor T1 to T7, a first capacitor (or storage capacitor) C1, and a second capacitor C2. The display element OLED may be an organic light-emitting diode including an anode and a cathode. The cathode may be a common electrode to which the second driving voltage ELVSS is applied. The first capacitor C1 may include a first electrode and a second electrode. The second capacitor C2 may include a third electrode and a fourth electrode.

The first transistor T1 may be a driving transistor in which an amount of a source-drain current is determined according to a gate-source voltage, and the second to seventh transistors T2 to T7 may be switching transistors that are turned on/off according to the gate-source voltage, substantially a gate voltage. Each of the second to seventh transistors T2 to T7 may be configured by one switching transistor, or a plurality of switching transistors that are simultaneously controlled in response to the same gate signal and connected in series to one another. In an embodiment, the first to seventh transistor T1 to T7 may be formed or provided as thin film transistors.

The first transistor T1 may be also referred to as the driving transistor, the second transistor T2 may be also referred to as the scan transistor, the third transistor T3 may be also referred to as the compensation transistor, the fourth transistor T4 may be also referred to as the gate initialization transistor, the fifth transistor T5 may be also referred to as the first emission control transistor, the sixth transistor T6 may be also referred to as the second emission control transistor, and the seventh transistor T7 may be also referred to as the anode initialization transistor.

The driving transistor T1 may control an amount of a driving current Id flowing from the power line PL_j to the display element OLED, according to the gate-source voltage. The driving transistor T1 may include a gate connected to a second electrode of the first capacitor C1, a source S connected to the power line PL_j via the first emission control transistor T5, and a drain D connected to the display element OLED via the second emission control transistor T6.

The driving transistor T1 may output the driving current Id to the display element OLED. The amount of the driving current Id may be determined based on the gate-source voltage of the driving transistor T1. The gate-source voltage of the driving transistor T1 amounts to a difference between a gate voltage and a source voltage. In an embodiment, the amount of the driving current Id may be determined based on a difference between the gate-source voltage of the driving transistor T1 and the threshold voltage Vth of the driving transistor T1, for example. The display element OLED may receive the driving current Id from the driving transistor T1, and emit light at a brightness according to the amount of the driving current Id.

The scan transistor T2 receives the data voltage Dj in response to the first scan signal GW_i. The scan transistor T2 transmits the data voltage Dj to the source S of the driving transistor T1 in response to the first scan signal GW_i. The scan transistor T2 may include a gate connected to the first scan line GWL_i, a source S connected to the data line DL_j, and a drain D connected to the source S of the driving transistor T1.

The first capacitor C1 is connected to the gate of the driving transistor T1. The first capacitor C1 may be connected between the power line PL_j and the gate of the driving transistor T1. The first capacitor C1 may include a first electrode connected to the power line PL_j, and a second electrode connected to the gate of the driving transistor T1. The first capacitor C1 may store a difference between the first driving voltage ELVDD applied to the power line PL_j and the gate voltage of the driving transistor T1, and maintain the gate voltage of the driving transistor T1.

The first capacitor C1 may store substantially the gate-source voltage of the driving transistor T1 during an emission section. However, even when the level of the first driving voltage ELVDD is maintained constant, due to a leakage current, the potential (e.g. electric potential) of the gate of the driving transistor T1 may be changed. In an embodiment, as a leakage current flows in the gate of the driving transistor T1, during the emission section, the gate voltage of the driving transistor T1 may gradually increase, for example. Accordingly, the source-gate voltage of the driving transistor T1 decrease, and thus the amount of the driving current Id may decrease as well. The brightness of the display element OLED may gradually decrease from a target amount.

The compensation transistor T3 is connected between the gate and drain D of the driving transistor T1, and in response to the first scan signal GW_i, may connect the gate and drain D of the driving transistor T1 to each other. The compensation transistor T3 may include first and second compensation transistors T3*a* and T3*b* that are simultaneously controlled by the first scan signal GW_i and connected in series between the gate and drain D of the driving transistor T1.

The first compensation transistor T3*a* may include a gate connected to the first scan line GWL_i, a source S connected to a floating node FN, and a drain D connected to the gate of the driving transistor T1. The second compensation transistor T3*b* may include a gate connected to the first scan line GWL_i, a source S connected to the drain D of the driving transistor T1, and a drain D connected to the floating node FN.

When the first compensation transistor T3*a* and the second compensation transistor T3*b* are turned on in response to the first scan signal GW_i, the drain D and gate of the driving transistor T1 are connected to each other so that the driving transistor T1 may be diode-connected. The source S of the driving transistor T1 receives the data voltage Dj in response to the first scan signal GW_i, and the data voltage Dj is transmitted to the gate of the driving transistor T1 via the driving transistor T1 that is diode-connected. When the gate voltage of the driving transistor T1 amounts to a voltage obtained by subtracting the threshold voltage Vth of the driving transistor T1 from the data voltage Dj, the driving transistor T1 is turned off, and the voltage obtained by subtracting the threshold voltage Vth of the driving transistor T1 from the data voltage Dj is stored in the first capacitor C1.

When the first compensation transistor T3*a* and the second compensation transistor T3*b* are turned off in response to the first scan signal GW_i, the floating node FN is substantially floating. The potential (e.g. electric potential) of the floating node FN varies depending on surrounding signals, for example, the first scan signal GW_i and the second scan signal GI_i. In particular, the electric potential of the floating node FN rises (or is increased) by being coupled to a rising edge of the first scan signal GW_i. Accordingly, the source-drain voltage of the first compensation transistor T3*a* is increased, so that the turn-off current, that is, a leakage current, of the first compensation transistor T3*a* is increased.

When the first compensation transistor T3*a* and the second compensation transistor T3*b* are turned off, the drain D and gate of the driving transistor T1 are ideally insulated from each other. However, actually, a minute current flows from the drain D to the gate of the driving transistor T1, which is also referred to as the turn-off current, or the leakage current because the current makes it impossible to maintain the gate voltage of the driving transistor T1 constant in terms of the first capacitor C1.

The gate initialization transistor T4 applies, in response to the second scan signal GI_i, the initialization voltage VINT to the gate of the driving transistor T1. The gate initialization transistor T4 may include first and second gate initialization transistors T4*a* and T4*b* that are simultaneously controlled by the second scan signal GI_i and connected in series between the gate of the driving transistor T1 and the voltage line VL_i.

The first gate initialization transistor T4*a* may include a gate connected to the second scan line GIL_i, a source S connected to the gate of the driving transistor T1, and a drain D connected to a source S of the second gate initialization transistor T4*b*. The second gate initialization transistor T4*b* may include a gate connected to the second scan line GIL_i, the source S connected to the drain D of the first gate initialization transistor T4*a*, and a drain D connected to the voltage line VL_i through which the initialization voltage VINT is transferred.

The anode initialization transistor T7 applies, in response to the third scan signal GB_i, the initialization voltage VINT to an anode of the display element OLED. The anode initialization transistor T7 may include a gate connected to a third scan line GBL_i, a source S connected to the anode of the display element OLED, and a drain D connected to the voltage line VL_i.

The first and second emission control transistors T5 and T6 may generate, in response to the emission control signal EM_i, a path of the driving current Id between the power line PL_j and the display element OLED.

The first emission control transistor T5 may connect, in response to the emission control signal EM_i, the power line PL_j and the source S of the driving transistor T1 to each other. The first emission control transistor T5 may include a gate connected to the emission control line EML_i, a source S connected to the power line PL_j, and a drain D connected to the source S of the driving transistor T1.

The second emission control transistor T6 may connect, in response to the emission control signal EM_i, the drain D of the driving transistor T1 and the anode of the display element OLED to each other. The second emission control transistor T6 may include a gate connected to the emission control line EML_i, a source S connected to the drain D of the driving transistor T1, and a drain D connected to the anode of the display element OLED.

The second capacitor C2 may be connected between the floating node FN between the first and second compensation transistors T3*a* and T3*b* and the emission control line EML_i. The second capacitor C2 may be connected between the floating node FN and the gate of the first emission control transistor T5. The second capacitor C2 may be connected between the floating node FN and the gate of the second emission control transistor T6. The second capacitor C2 may include a third electrode connected to the floating node FN and a fourth electrode connected to the emission control line EML_i.

As the second capacitor C2 is connected between the floating node FN and the emission control line EML_i, a potential change amount of the floating node FN by the rising edge of the first scan signal GW_i may be at least partially offset by a potential change amount of the floating node FN by the falling edge of the emission control signal EM_i. Consequently, the amount of a leakage current flowing from the floating node FN to the gate T1_G of the driving transistor T1 may be reduced, which is described below in detail with reference to FIG. 4.

Figure 3:
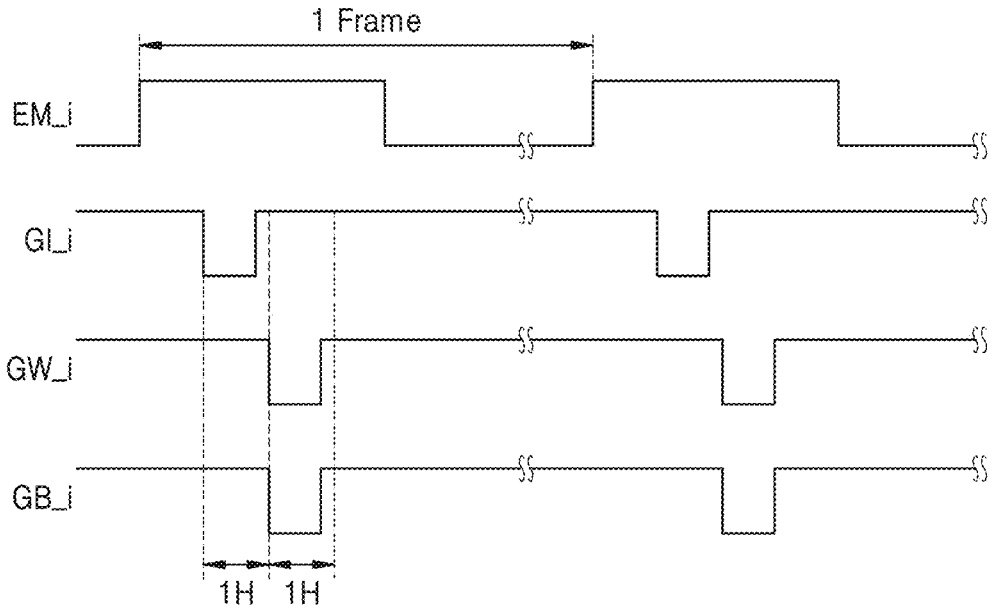
FIG. 3 is a timing diagram of control signals to operate the pixel circuit of FIG. 2.

FIG. 3 is a timing diagram of the control signals to operate the pixel circuit of FIG. 2.

Referring to FIGS. 2 and 3, in a section in which the emission control signal EM_i has a high level, the first and second emission control transistors T5 and T6 are turned off. The section in which the emission control signal EM_i has a high level may be also referred to as the non-emission section.

In the non-emission section, the driving transistor T1 stops outputting the driving current Id, and the display element OLEDs stops emitting light.

The second scan signal GI_i has a first low level. A section in which the second scan signal GI_i has a low-level pulse voltage may be also referred to as the gate initialization section.

During the gate initialization period, the gate initialization transistor T4 is turned on, and the initialization voltage VINT is applied to the gate of the driving transistor T1, that is, the second electrode of the first capacitor C1. A difference (ELVDD-VINT) between the first driving voltage ELVDD and the initialization voltage VINT is stored in the first capacitor C1.

After the second scan signal GI_i is shifted to the high level, the first scan signal GW_i has a low level. A section in which the first scan signal GW_i has a low-level pulse voltage may be also referred to as the data write period.

During the data write period, the scan transistor T2 and the compensation transistor T3 are turned on, the data voltage Dj is received by the source S of the driving transistor T1. The driving transistor T1 is diode-connected by the compensation transistor T3, and is biased in a forward direction. The voltage of the second electrode of the first capacitor C1 is increased from the initialization voltage VINT. When the gate voltage of the driving transistor T1 amounts to a voltage (Dj−|Vth|) obtained by subtracting the threshold voltage Vth of the driving transistor T1 from the data voltage Dj, the driving transistor T1 is turned off and the increase of the gate voltage of the driving transistor T1 is stopped. Accordingly, the gate voltage of the driving transistor T1 amounts to (Dj−|Vth|), and a difference (ELVDD−Dj+|Vth|) between the first driving voltage ELVDD and the gate voltage (Dj−|Vth|) is stored in the first capacitor C1.

Furthermore, after the second scan signal GI_i is shifted to the high level, the third scan signal GB_i has a low level. A section in which the third scan signal GB_i has a low-level pulse voltage may be also referred to as the anode initialization section.

During the anode initialization period, the anode initialization transistor T7 is turned on, and the initialization voltage VINT is applied to the anode of the display element OLED. As the display element OLED does not emit light at all by applying the initialization voltage VINT to the anode of the display element OLED, a phenomenon that the display element OLED subtly emits light in a next frame in response to black gradation may be removed.

Thereafter, the first scan signal GW_i and the third scan signal GB_i are shifted to the high level, and the emission control signal EM_i has a low level. A section in which the emission control signal EM_i has a low level may be also referred to as the emission section.

During the emission section, the first and second emission control transistors T5 and T6 are turned on. The driving transistor T1 outputs the driving current Id having an amount corresponding to the voltage stored in the first capacitor C1, that is, a voltage (ELVDD−Dj) obtained by subtracting the threshold voltage (|Vth|) of the driving transistor T1 from the source-gate voltage (ELVDD−Dj+|Vth|) of the driving transistor T1, and the display element OLED may emit light with a luminance corresponding to the amount of the driving current Id.

The second scan signal GI_i may be substantially synchronized with a first scan signal GW_i−1 in the previous row. The third scan signal GB_i may be substantially synchronized with the first scan signal GW_i. In another embodiment, the third scan signal GB_i may be substantially synchronized with a first scan signal GW_i+1 in the next row. A difference between a timing when the second scan signal GI_i has a falling edge and a timing when the first scan signal GW_i has a falling edge may be one horizontal scanning period 1H.

Figure 4:
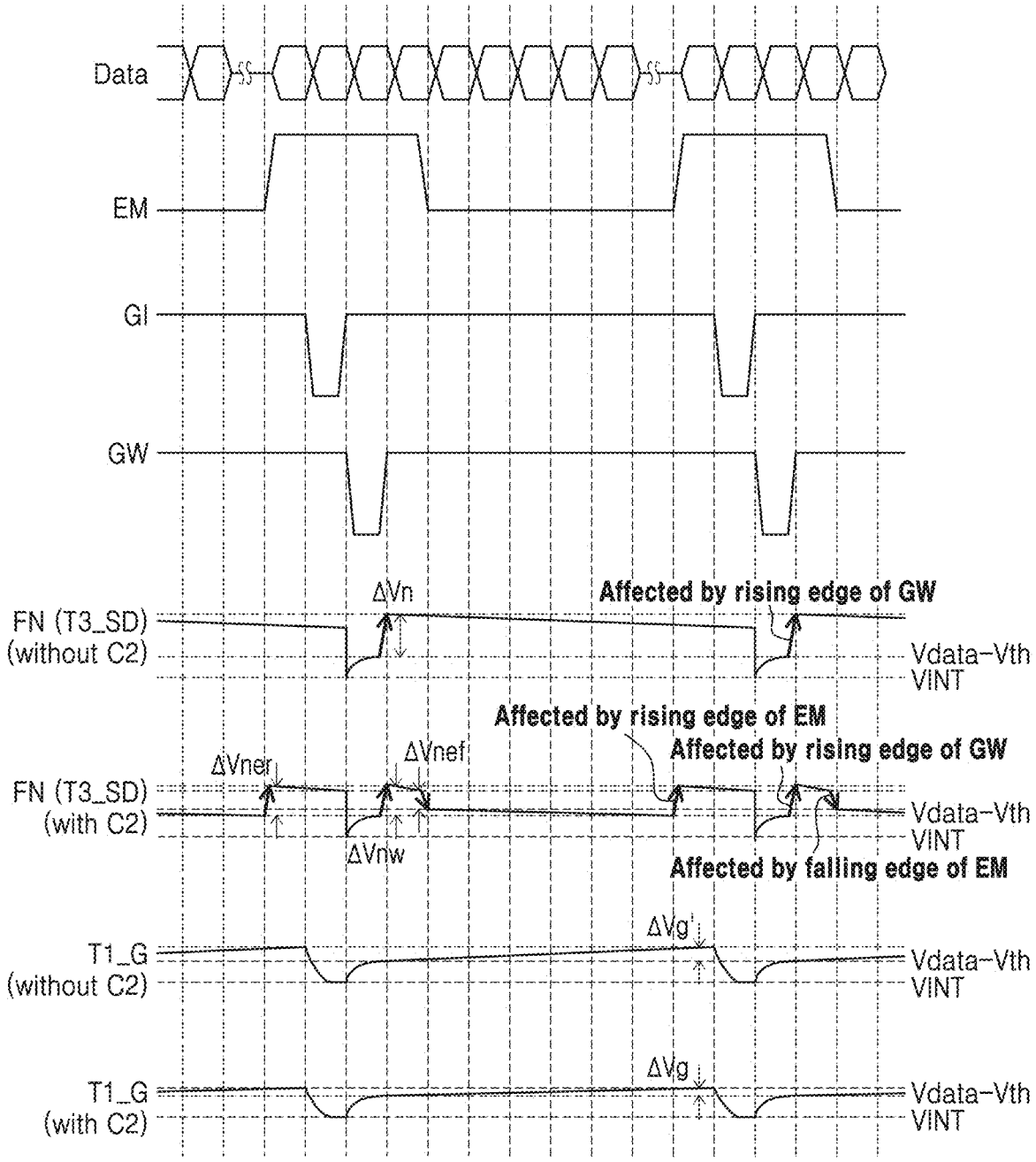
FIG. 4 illustrates voltage waveforms of some nodes of the pixel circuit of FIG. 2.

FIG. 4 illustrates voltage waveforms of some nodes of the pixel circuit of FIG. 2.

Referring to FIGS. 2 and 4, a data signal Data is transferred through a data line DL, an emission control signal EM is transferred through an emission control line EML, a first scan signal GW is transferred through a first scan line GWL, and a second scan signal GI is transferred through a second scan line GIL.

Furthermore, voltage waveforms of the floating node FN (T3_SD) and the gate T1_G of the driving transistor T1 in this state are illustrated. The voltage level of the data signal Data is indicated by a data voltage Vdata, and the absolute value of the threshold voltage of the driving transistor T1 is briefly indicated by Vth.

First, in a section in which the second scan signal GI has a low level, the initialization voltage VINT is applied to the gate T1_G of the driving transistor T1.

Thereafter, in a section in which the first scan signal GW has a low level, the electric potential of the gate T1_G of the driving transistor T1 is increased (or rises) from the initialization voltage VINT to a voltage (Vdata-Vth) obtained by subtracting the threshold voltage Vth from the data voltage Vdata. In this state, as the first and second compensation transistors T3*a* and T3*b* are turned on, the electric potential of the floating node FN increases to the voltage (Vdata-Vth) obtained by subtracting the threshold voltage Vth from the data voltage Vdata.

Thereafter, when the first scan signal GW has a rising edge, the first and second compensation transistors T3*a* and T3*b* are turned off, and the floating node FN is floating.

The electric potential of the floating node FN may be increased (or rise) by a first potential change amount ΔVnw by the rising edge of the first scan signal GW. The electric potential of the floating node FN increased by the first potential change amount ΔVnw varies depending on the turn-off current of the first and second compensation transistors T3*a* and T3*b*. In an embodiment, as illustrated in FIG. 4, the electric potential of the floating node FN may be gradually decreased (or fall), for example.

Thereafter, when the emission control signal EM has a falling edge, the floating node FN is capacitive coupled by the second capacitor C2 not only to the first scan line GWL, but also to the emission control line EML, and thus, the electric potential of the floating node FN may be dropped by a second potential change amount ΔVnef by the falling edge of the emission control signal EM. The second potential change amount ΔVnef may vary depending on parasitic capacitance between the floating node FN and the first scan line GWL and parasitic capacitance between the floating node FN and other conductors. The first potential change amount ΔVnw of the floating node FN by the rising edge of the first scan signal GW may be at least partially offset by the second potential change amount ΔVnef of the floating node FN by the falling edge of the emission control signal EM.

In a comparative example, when the second capacitor C2 does not exist, the floating node FN is mainly capacitive-coupled to the first scan line GWL. The electric potential of the floating node FN may be increased by a fourth potential change amount ΔVn by the rising edge of the first scan signal GW. The fourth potential change amount ΔVn may be greater than the first potential change amount ΔVnw, as illustrated in FIG. 4. When the second capacitor C2 does not exist, the floating node FN is mainly capacitive-coupled to the first scan line GWL, whereas when the second capacitor C2 exists, the floating node FN is capacitive-coupled not only to the first scan line GWL, but also to the emission control line EML. Accordingly, when the second capacitor C2 exists, at the moment when the first scan signal GW has a rising edge, the floating node FN is coupled even to the emission control signal EM having a constant level, an increase (or rising) width of the electric potential of the floating node FN is relatively small. Accordingly, the fourth potential change amount ΔVn may be greater than the first potential change amount ΔVnw.

Although FIG. 4 illustrates that after the first scan signal GW has a rising edge, the emission control signal EM has a falling edge, in another embodiment, the emission control signal EM may have a falling edge at the moment when the first scan signal GW has a rising edge. In this case, the electric potential of the floating node FN may increase by a value obtained by subtracting the second potential change amount ΔVnef from the first potential change amount ΔVnw.

Thereafter, the electric potential of the floating node FN decreased by the second potential change amount ΔVnef varies depending on the turn-off current of the first and second compensation transistors T3*a* and T3*b*. In an embodiment, as illustrated in FIG. 4, the electric potential of the floating node FN may be gradually decreased, for example.

Thereafter, when the emission control signal EM has a rising edge, the electric potential of the floating node FN may be increased by a third potential change amount ΔVner by the rising edge of the emission control signal EM. The third potential change amount ΔVner may vary depending on the parasitic capacitance between the floating node FN and the first scan line GWL and the parasitic capacitance between the floating node FN and other conductors. As the electric potential of the floating node FN is increased by the third potential change amount ΔVner so that the leakage current flowing from the floating node FN to the gate T1_G of the driving transistor T1 is increased, due to the emission control signal EM of a high level, the display element OLED does not emit light and the reduction of the luminance of the display element is not affected.

Thereafter, the electric potential of the floating node FN increased by the third potential change amount ΔVner varies depending on the turn-off current of the first and second compensation transistors T3*a* and T3*b*. In an embodiment, as illustrated in FIG. 4, the electric potential of the floating node FN may be gradually decreased, for example.

As the second scan signal GI and the first scan signal GW both have a high level, the first and second compensation transistors T3*a* and T3*b*, and the first and second gate initialization transistors T4*a* and T4*b*, are all turned off, but a minute turn-off current may flow. Accordingly, the voltage of the gate T1_G of the driving transistor T1 may be slowly increased (or rise).

In a comparative example, when the second capacitor C2 does not exist, the leakage current flowing from the floating node FN to the gate T1_G of the driving transistor T1 through the first compensation transistor T3*a* that is turned off may be much large due to the electric potential of the floating node FN increased by the fourth potential change amount ΔVn. The voltage of the gate T1_G of the driving transistor T1 may be gradually increased by the leakage current flowing from the floating node FN to the gate T1_G of the driving transistor T1.

In the illustrated embodiment, through the second capacitor C2 connected to the emission control line EML, the floating node FN may be capacitive-coupled not only to the first scan line GWL, but also to the emission control line EML. Accordingly, at the moment when the first scan signal GW has a rising edge, the floating node FN is coupled even to the emission control signal EM having a constant level, and therefore an increase width of the electric potential of the floating node FN may be relatively decreased by the rising edge of the first scan signal GW.

Furthermore, the first potential change amount ΔVnw of the floating node FN by the rising edge of the first scan signal GW may be at least partially offset by the second potential change amount ΔVnef of the floating node FN by the falling edge of the emission control signal EM. The electric potential of the floating node FN may be increased by the rising edge of the first scan signal GW, and decreased by the falling edge of the emission control signal EM. As such, unlike the comparative example, the electric potential of the floating node FN increased by the rising edge of the first scan signal GW is decreased by the falling edge of the emission control signal EM, compared to the comparative example, through the first compensation transistor T3*a* that is turned off, the amount of a leakage current may be decreased. Accordingly, an amount change of the driving current output by the driving transistor T1 may be decreased, and the luminance change of the display element OLED may be decreased as well.

Figure 5:
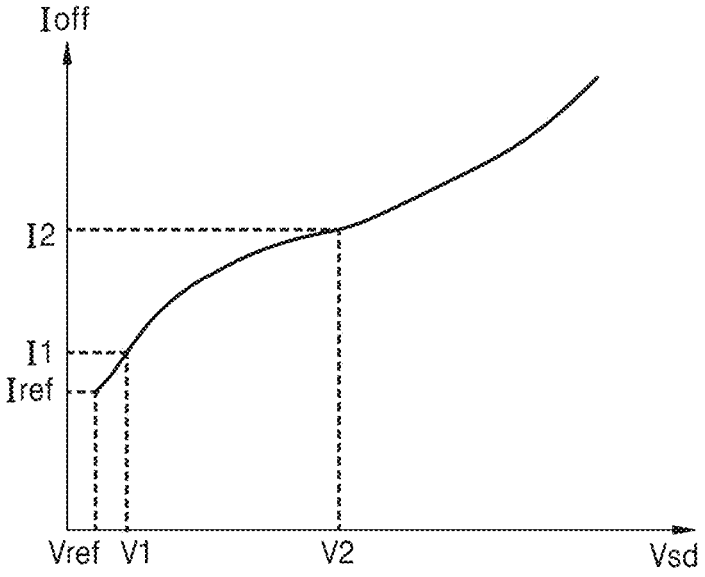
FIG. 5 is a graph of a change of a turn-off current according to a source-drain voltage.

FIG. 5 is a graph of a change of a turn-off current according to a source-drain voltage.

Referring to FIG. 5, it may be seen that, as a source-drain voltage Vsd increases, a turn-off current Ioff increases as well. It is assumed that a reference source-drain voltage Vref is 0, and that a reference turn-off current Iref is 0. Such a case corresponds to an ideal case without leakage current.

In a comparative example, as described in FIG. 4, when the second capacitor C2 does not exist, the electric potential of the floating node FN may be much increased by the rising edge of the first scan signal GW. A second source-drain voltage V2 of the first compensation transistor T3*a* that is turned off may be much greater than the reference source-drain voltage Vref, and a second turn-off current I2 of the first compensation transistor T3*a* that is turned off may also be much greater than the reference turn-off current Iref. In other words, a leakage current may be much large.

In the illustrated embodiment, as described in FIG. 4, the first potential change amount ΔVnw of the floating node FN by the rising edge of the first scan signal GW may be at least partially offset by the second potential change amount ΔVnef of the floating node FN by the falling edge of the emission control signal EM. Accordingly, compared with the comparative example, a first source-drain voltage V1 of the first compensation transistor T3*a* that is turned off may be slightly greater than the reference source-drain voltage Vref. A first turn-off current I1 of the first compensation transistor T3*a* that is turned off may also be slightly greater than the reference turn-off current Iref. In other words, compared with the comparative example, the amount of a leakage current may be reduced.

Figure 6:
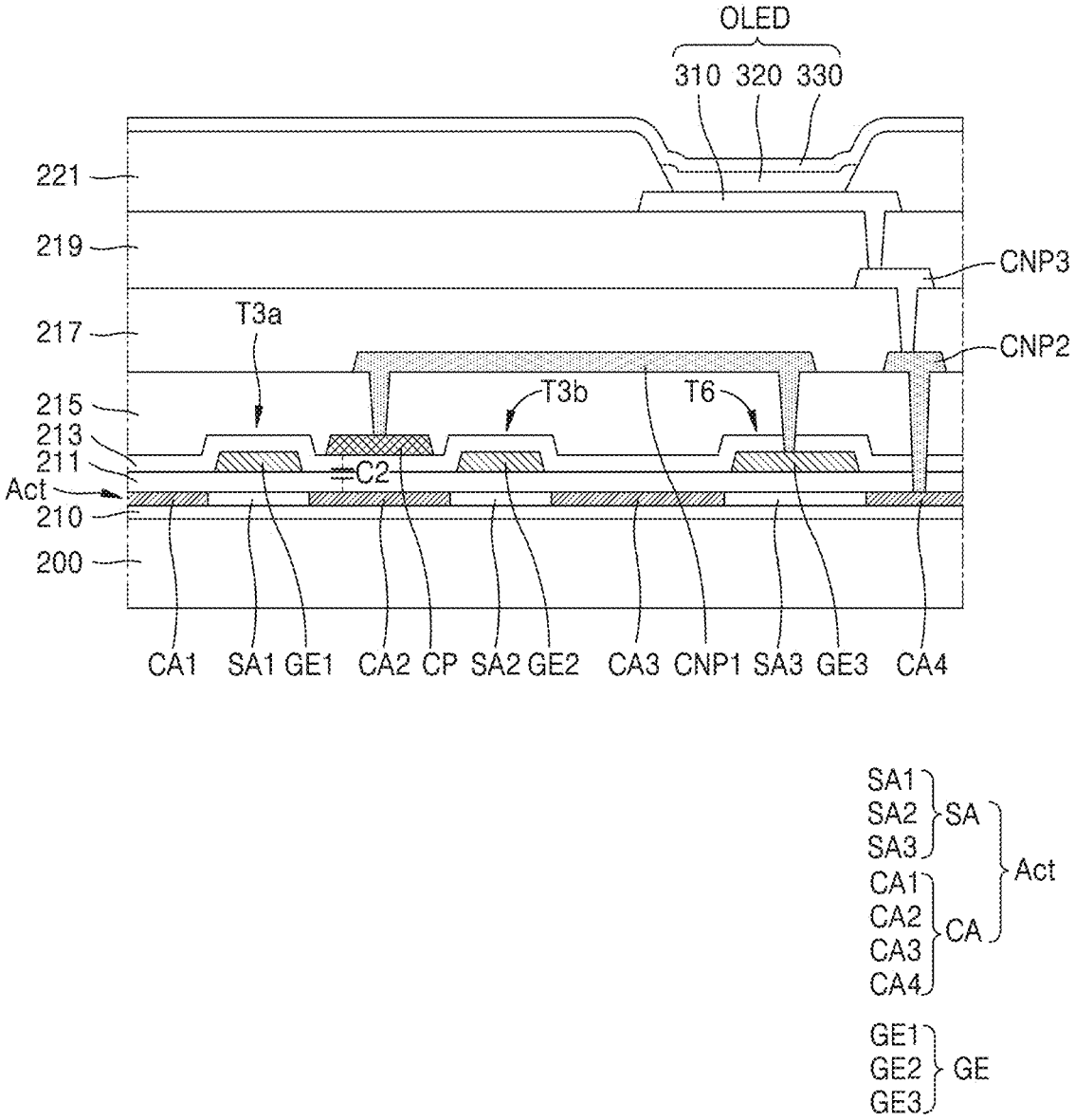
FIG. 6 is a schematic cross-sectional view of the pixel of FIG. 2.

FIG. 6 is a schematic cross-sectional view of the pixel of FIG. 2.

Referring to FIG. 6, the first compensation transistor T3*a*, the second compensation transistor T3*b*, the second emission control transistor T6, the second capacitor C2, and the display element OLED may be arranged on and above a substrate 200.

Each of the first compensation transistor T3*a*, the second compensation transistor T3*b*, and the second emission control transistor T6 may include partial areas or parts of the gate electrode and a semiconductor layer Act.

In an embodiment, the first compensation transistor T3*a* may include a first gate electrode GE1, a first conductive area CA1 of the semiconductor layer Act, a first semiconductor area SA1 of the semiconductor layer Act, and a second conductive area CA2 of the semiconductor layer Act, for example. The first gate electrode GE1 and the first semiconductor area SA1 of the semiconductor layer Act may overlap each other. The first gate electrode GE1 may correspond to the gate of the first compensation transistor T3*a*, the first conductive area CA1 of the semiconductor layer Act may correspond to the drain D (refer to FIG. 2) of the first compensation transistor T3*a*, and the second conductive area CA2 of the semiconductor layer Act may correspond to the source S (refer to FIG. 2) of the first compensation transistor T3*a*.

The second compensation transistor T3*b* may include a second gate electrode GE2, the second conductive area CA2 of the semiconductor layer Act, a second semiconductor area SA2 of the semiconductor layer Act, and a third conductive area CA3 of the semiconductor layer Act. The second gate electrode GE2 and the second semiconductor area SA2 of the semiconductor layer Act may overlap each other. The second gate electrode GE2 may correspond to the gate of the second compensation transistor T3*b*, the second conductive area CA2 of the semiconductor layer Act may correspond to the drain D (refer to FIG. 2) of the second compensation transistor T3*b*, and the third conductive area CA3 of the semiconductor layer Act may correspond to the source S (refer to FIG. 2) of the second compensation transistor T3*b*.

The second emission control transistor T6 may include a third gate electrode GE3, the third conductive area CA3 of the semiconductor layer Act, a third semiconductor area SA3 of the semiconductor layer Act, and a fourth conductive area CA4 of the semiconductor layer Act. The third gate electrode GE3 and the third semiconductor area SA3 of the semiconductor layer Act may overlap each other. The third gate electrode GE3 may correspond to the gate of the second emission control transistor T6, the third conductive area CA3 of the semiconductor layer Act may correspond to the source S (refer to FIG. 2) of the second emission control transistor T6, the fourth conductive area CA4 of the semiconductor layer Act may correspond to the drain D (refer to FIG. 2) of the second emission control transistor T6.

The first and second gate electrodes GE1 and GE2 may correspond to a part of the first scan line GWL_i of FIG. 2. In other words, the first scan line GWL_i may include the first and second gate electrodes GE1 and GE2. In other words, parts of the first scan line GWL_i overlapping the semiconductor layer Act may be also referred to as the first and second gate electrodes GE1 and GE2, respectively. In an embodiment, one part of the first scan line GWL_i overlapping the first semiconductor area SA1 of the semiconductor layer Act may be also referred to as the first gate electrode GE1, and the other part of the first scan line GWL_i overlapping the second semiconductor area SA2 of the semiconductor layer Act may be also referred to as the second gate electrode GE2, for example. The first scan signal GW_i of FIG. 2 may be applied to the first and second gate electrodes GE1 and GE2.

The third gate electrode GE3 may correspond to a part of the emission control line EML_i of FIG. 2. In other words, the emission control line EML_i may include the third gate electrode GE3. In other words, a part of the emission control line EML_i overlapping the semiconductor layer Act may be also referred to as the third gate electrode GE3. In an embodiment, a part of the emission control line EML_i overlapping the third semiconductor area SA3 of the semiconductor layer Act may be also referred to as the third gate electrode GE3, for example. The emission control signal EM_i of FIG. 2 may be applied to the third gate electrode GE3.

Referring back to FIG. 6, the second capacitor C2 may include a conductive pattern CP, and a part of the semiconductor layer Act at least partially overlapping the conductive pattern CP. In an embodiment, the second capacitor C2 may include the conductive pattern CP, and the second conductive area CA2 of the semiconductor layer Act at least partially overlapping the conductive pattern CP, for example. The conductive pattern CP may correspond to the third electrode of the second capacitor C2, and the second conductive area CA2 of the semiconductor layer Act may correspond to the fourth electrode of the second capacitor C2.

The fourth electrode of the second capacitor C2 may be connected to the gate of the second emission control transistor T6. In an embodiment, as illustrated in FIG. 6, the conductive pattern CP may be connected to the third gate electrode GE3 through a first connection pattern CNP1, for example.

The configuration of the pixel is described below in detail with reference to FIG. 6 according to a stack structure.

The substrate 200 may include glass or polymer resin. In an embodiment, the polymer resin may include polyethersulfone, polyacrylate, polyetherimide, polyethylene naphthalate, polyethylene terephthalate, polyphenylene sulfide, polyarylate, polyimide, polycarbonate, cellulose acetate propionate, or the like. The substrate 200 including polymer resin may have flexible, rollable, or bendable properties. The substrate 200 may have a multilayer structure including a layer including the above-described polymer resin and an inorganic layer (not shown).

A buffer layer 210 may reduce or block infiltration of foreign materials such as moisture or external air from under the substrate 200, and provide a planarized surface to an upper side of the substrate 200. The buffer layer 210 may include an inorganic material such as oxide or nitride, an organic material, or an organic/inorganic complex, and have a single layer or multilayer structure of an inorganic material and an organic material.

A barrier layer (not shown) may be further provided between the substrate 200 and the buffer layer 210. The barrier layer may prevent or reduce infiltration of impurities from the substrate 200 or the like into the semiconductor layer Act. The barrier layer may include an inorganic material such as oxide or nitride, or an organic material, or an organic/inorganic complex, and have a single layer or multilayer structure of an inorganic material and an organic material.

The semiconductor layer Act may be arranged on the buffer layer 210. In an embodiment, the semiconductor layer Act may include amorphous silicon or poly silicon. In another embodiment, the semiconductor layer Act may include an oxide of at least material including at least one of indium (In), gallium (Ga), stannum (Sn), zirconium (Zr), vanadium (V), hafnium (Hf), cadmium (Cd), germanium (Ge), chromium (Cr), titanium (Ti), aluminum (Al), cesium (Cs), cerium (Ce), and zinc (Zn).

The semiconductor layer Act may include a semiconductor area SA and a conductive area CA. The conductive area CA may be a doped area by adding a dopant. The semiconductor layer Act may be configured as a single layer or multilayer.

A first gate insulating layer 211 and a second gate insulating layer 213 may be stacked on the substrate 200 to cover the semiconductor layer Act. In an embodiment, the first gate insulating layer 211 and the second gate insulating layer 213 may include a silicon oxide ($SiO_2$), a silicon nitride ($SiN_x$), a silicon oxynitride (SiON), an aluminum oxide ($Al_2O_3$), a titanium oxide ($TiO_2$), a tantalum oxide ($Ta_2O_5$), a hafnium oxide ($HfO_2$), a zinc oxide ($ZnO_2$), or the like.

A gate electrode GE may be arranged on the first gate insulating layer 211. The gate electrode GE may be arranged to at least partially overlap the semiconductor layer Act. A partial area of the semiconductor layer Act overlapping the gate electrode GE may be also referred to as the semiconductor area SA. In an embodiment, the gate electrode GE may include molybdenum (Mo), aluminum (Al), copper (Cu), titanium (Ti), or the like, and may be configured as a single layer or multilayer. In an embodiment, the gate electrode GE may be a single layer of molybdenum (Mo).

The conductive pattern CP of the second capacitor C2 may be arranged on the second gate insulating layer 213. In an embodiment, the conductive pattern CP of the second capacitor C2 may include Mo, Al, Cu, Ti, or the like, and may be configured as a single layer or multilayer. In an embodiment, the conductive pattern CP of the second capacitor C2 may be configured as a single layer of molybdenum (Mo).

The conductive pattern CP of the second capacitor C2 at least partially overlaps the second conductive area CA2 of the semiconductor layer Act with the first and second gate insulating layers 211 and 213 therebetween, and forms capacitance. In this case, the first and second gate insulating layers 211 and 213 may function as a dielectric layer of the second capacitor C2.

An inter-insulating layer 215 may be provided on the second gate insulating layer 213 to cover the conductive pattern CP of the second capacitor C2. In an embodiment, the inter-insulating layer 215 may include $SiO_2$, $SiN_x$, SiON, $Al_2O_3$, $TiO_2$, $Ta_2O_5$, $HfO_2$, $ZnO_2$, or the like The first and second connection patterns CNP1 and CNP2 may be arranged on the inter-insulating layer 215. The first and second connection patterns CNP1 and CNP2 may include a conductive material including Mo, Al, Cu, Ti, or the like, and may be configured as a multilayer or a single layer including the above materials. In an embodiment, the first and second connection patterns CNP1 and CNP2 may have a multilayer structure of Ti/Al/Ti.

The first connection pattern CNP1 may connect the second capacitor C2 to the gate of the second emission control transistor T6. In an embodiment, as illustrated in FIG. 6, one end of the first connection pattern CNP1 may be connected to the conductive pattern CP of the second capacitor C2 via a contact hole defined in the inter-insulating layer 215, and the other end of the first connection pattern CNP1 may be connected to the third gate electrode GE3 of the second emission control transistor T6 via a contact hole defined in the second gate insulating layer 213 and the inter-insulating layer 215, for example.

The second connection pattern CNP2 may be connected to the second emission control transistor T6. The second connection pattern CNP2 may be connected to the drain D (refer to FIG. 2) of the second emission control transistor T6. In an embodiment, as illustrated in FIG. 6, the second connection pattern CNP2 may be connected to the fourth conductive area CA4 of the semiconductor layer Act via a contact hole defined in the first gate insulating layer 211, the second gate insulating layer 213, and the inter-insulating layer 215, for example.

The first and second connection patterns CNP1 and CNP2 may be covered with an inorganic protection layer (not shown). In an embodiment, the inorganic protection layer may be a single layer or multilayer layer of a silicon nitride ($SiN_x$) and a silicon oxide ($SiO_x$). The inorganic protection layer may be introduced to cover and protect some wiring/interconnections arranged on the inter-insulating layer 215.

A planarization layer may be arranged to cover the first and second connection patterns CNP1 and CNP2, and contact holes may be defined in the planarization layer to connect the transistor to a pixel electrode 310.

The planarization layer may be configured as a single layer or multilayer of an organic material, and may provide a flat upper surface. In an embodiment, the planarization layer may include general purpose polymers such as benzocyclobutene ("BCB"), polyimide, hexamethyldisiloxane ("HMDSO"), polymethylmethacrylate ("PMMA"), or polystyrene ("PS"), polymer derivatives having a phenolic group, acrylic polymers, imide-based polymers, aryl ether-based polymers, amide-based polymers, fluorine-based polymers, p-xylene-based polymers, vinyl alcohol-based polymers, a combination thereof, or the like.

The planarization layer may include a first planarization layer 217 and a second planarization layer 219. A third connection pattern CNP3 may be arranged on the first planarization layer 217. In an embodiment, the third connection pattern CNP3 may include a conductive material including Mo, Al, Cu, Ti, or the like, and may be configured as a multilayer or a single layer including the above materials. In an embodiment, the third connection pattern CNP3 may have a multilayer structure of Ti/Al/Ti.

The third connection pattern CNP3 may be connected to the second connection pattern CNP2, via a contact hole defined in the first planarization layer 217, and to the second emission control transistor T6 connected to the second connection pattern CNP2.

The display element OLED may be arranged on the second planarization layer 219. The display element OLED may include the pixel electrode 310, an intermediate layer 320 including an organic emission layer, and a counter electrode 330. The display element OLED may be connected to the second emission control transistor T6 via a contact hole defined in the second planarization layer 219 and the second and third connection patterns CNP2 and CNP3.

In an embodiment, the pixel electrode 310 may be a (semi-)transmissive electrode or a reflective electrode. In some embodiments, the pixel electrode 310 may include a reflective layer including Ag, Mg, Al, Pt, Pd, Au, Ni, Nd, Ir, Cr, a combination thereof, or the like, and a transparent or semi-transparent electrode layer formed or disposed on the reflective layer. In an embodiment, the transparent or semi-transparent electrode layer may include at least one material including at least one of an indium tin oxide ("ITO"), an indium zinc oxide ("IZO"), a zinc oxide (ZnO), an indium oxide ($In_2O_3$), an indium gallium oxide ("IGO"), and an aluminum zinc oxide ("AZO"). In some embodiments, the pixel electrode 310 may include ITO/Ag/ITO.

In a display area of the substrate 200, a pixel define layer 221 may be arranged on the second planarization layer 219. The pixel define layer 221 may cover an edge of the pixel electrode 310, and an opening that exposes a central portion of the pixel electrode 310 may be defined in the pixel define layer 221. A light-emitting area of the display element OLED may be defined by the opening.

As the pixel define layer 221 increases a distance between the edge of the pixel electrode 310 and the counter electrode 330 above the pixel electrode 310, arc or the like may be prevented from being generated at the edge of the pixel electrode 310.

In an embodiment, the pixel define layer 221 may include one or more organic insulating materials including at least one of polyimide, polyamide, acryl resin, benzocyclobutene, and phenol resin, by a method such as spin coating or the like. The pixel define layer 221 may include an organic insulating material. In an alternative embodiment, the pixel define layer 221 may include an inorganic insulating material such as a silicon nitride, a silicon oxynitride, or a silicon oxide. In an alternative embodiment, the pixel define layer 221 may include at least one of an organic insulating material and an inorganic insulating material. In some embodiments, the pixel define layer 221 may include a light shield material, and may be provided in black. In an embodiment, the light shield material may include resin or paste including carbon black, carbon nanotube, or black dye, metal particles, for example, nickel, aluminum, molybdenum, and an alloy thereof, metal oxide particles, for example, a chromium oxide, metal nitride particles, for example, a chromium nitride, or the like. When the pixel define layer 221 includes a light shield material, external light reflection may be reduced by a metal structures arranged below the pixel define layer 221.

The intermediate layer 320 may be arranged in the opening defined by the pixel define layer 221, and may include an organic emission layer. The organic emission layer may include an organic material including a fluorescent or phosphorescent material that emits red, green, blue, or white light. The organic emission layer may include a low molecular weight organic material or a polymer organic material, and a functional layer such as a hole transport layer ("HTL"), a hole injection layer ("HIL"), an electron transport layer ("ETL"), an electron injection layer ("EIL"), or the like may be optionally further arranged below or above the organic emission layer.

The counter electrode 330 may be a transmissive electrode or a reflective electrode. In some embodiments, the counter electrode 330 may be a transparent or semi-transparent electrode, and may include a metal thin film having a small work function including Li, Ca, LiF/Ca, LiF/Al, Al, Ag, Mg, and a combination thereof. Furthermore, a transparent conductive oxide ("TCO") film of ITO, IZO, ZnO, or $In_2O_3$, or the like may be further arranged on the metal thin film. The counter electrode 330 may be arranged across the display area and above the intermediate layer 320 and the pixel define layer 221. The counter electrode 330 is unitarily formed or provided in a plurality of display elements OLEDs to correspond to a plurality of pixel electrodes as the pixel electrode 310.

As the display element OLED is easily damaged by external moisture, oxygen, or the like, an encapsulation layer (not shown) is further provided to cover and protect the display element OLED. The encapsulation layer may cover the display area and extend to at least a part of a peripheral area. The encapsulation layer may include a first inorganic encapsulation layer, an organic encapsulation layer, and a second inorganic encapsulation layer.

According to various embodiments of the invention, a turn-off current of a switching transistor connected to a storage capacitor of a pixel may be reduced. Furthermore, as a leakage current flowing toward the gate of a driving transistor is reduced, a gate voltage of the driving transistor may be maintained constant. Accordingly, a display apparatus according to various embodiments of the invention may display a more vivid image.

It should be understood that embodiments described herein should be considered in a descriptive sense only and not for purposes of limitation. Descriptions of features or advantages within each embodiment should typically be considered as available for other similar features or advantages in other embodiments. While embodiments have been described with reference to the drawing figures, it will be understood by those of ordinary skill in the art that various changes in form and details may be made therein without departing from the spirit and scope as defined by the following claims.

What is claimed is:

1. A pixel comprising:

a display element;

a driving transistor which controls an amount of a driving current flowing toward the display element according to a gate-source voltage of the driving transistor;

a first capacitor connected to a gate of the driving transistor;

a scan transistor which transfers a data voltage to a source of the driving transistor in response to a first scan signal;

first and second compensation transistors which operate in response to a first scan signal, and which are connected to each other in series between the gate and a drain of the driving transistor;

first and second emission control transistors which generate, in response to an emission control signal, a path of the driving current between the display element and a power line which transfers a driving voltage; and a second capacitor connected between a floating node between the first and second compensation transistors and a gate of the second emission control transistor.

2. The pixel of claim 1, further comprising:

a semiconductor layer;

a first scan line which is arranged on the semiconductor layer and transfers the first scan signal, the first scan line comprising first and second gate electrodes and each of the first and second gate electrodes at least partially overlapping the semiconductor layer;

an emission control line which is arranged on the semiconductor layer and transfers the emission control signal, the emission control line comprising a third gate electrode which at least partially overlaps the semiconductor layer;

a conductive pattern arranged between the first and second gate electrodes, and at least partially overlapping the semiconductor layer; and a connection pattern arranged on the conductive pattern, and connecting the conductive pattern to the third gate electrode.

3. The pixel of claim 2, wherein the semiconductor layer comprises a semiconductor area at least partially overlapping the first to third gate electrodes, and a conductive area at least partially overlapping the conductive pattern.

4. The pixel of claim 3, wherein the second capacitor comprises the conductive pattern and the conductive area of the semiconductor layer.

5. The pixel of claim 1, further comprising a gate initialization transistor which applies, in response to a second scan signal, an initialization voltage to the gate of the driving transistor.

6. The pixel of claim 5, wherein the gate initialization transistor comprises first and second gate initialization transistors connected to each other in series between a voltage line which transfers the initialization voltage and the gate of the driving transistor.

7. The pixel of claim 5, wherein, in one frame period, after the gate initialization transistor is turned on in response to the second scan signal having a pulse voltage of a turn-on level, the scan transistor and the first and second compensation transistors turn on in response to the first scan signal having a pulse voltage of a turn-on level.

8. The pixel of claim 1, further comprising an anode initialization transistor which applies, in response to a third scan signal, an initialization voltage to an anode of the display element.

9. The pixel of claim 8, wherein the third scan signal is synchronized with the first scan signal.

10. The pixel of claim 1, wherein the first and second compensation transistors turn off in response to a rising edge of the first scan signal, the first and second emission control transistors turn on in response to a falling edge of the emission control signal, and a first potential change amount of the floating node in response to the rising edge of the first scan signal is at least partially offset by a second potential change amount of the floating node in response to the falling edge of the emission control signal.

11. The pixel of claim 1, wherein the first and second compensation transistors turn off in response to a rising edge of the first scan signal, the first and second emission control transistors turn on in response to a falling edge of the emission control signal, and a potential of the floating node rises by the rising edge of the first scan signal, and falls by the falling edge of the emission control signal.

12. The pixel of claim 1, wherein the first emission control transistor connects, in response to the emission control signal, the power line to the source of the driving transistor, and the second emission control transistor connects, in response to the emission control signal, the drain of the driving transistor to an anode of the display element.

13. The pixel of claim 1, wherein the first capacitor is connected between the power line and the gate of the driving transistor.

14. A pixel connected to first to third scan lines which transfer first to third scan signals, respectively, an emission control line which transfers an emission control signal, a data line which transfers a data voltage, a power line which transfers a driving voltage, and a voltage line which transfers an initialization voltage, the pixel comprising:

a display element comprising an anode and a cathode;

a first capacitor comprising a first electrode and a second electrode, the first electrode being connected to the power line;

a first transistor comprising a gate connected to the second electrode of the first capacitor, a source connected to the power line, and a drain;

a second transistor comprising a gate connected to the first scan line, a source connected to the data line, and a drain connected to the source of the first transistor;

a third transistor comprising a first compensation transistor and a second compensation transistor, the first compensation transistor comprising a gate connected to the first scan line, a source connected to a floating node, and a drain connected to the gate of the first transistor, and the second compensation transistor comprising a gate connected to the first scan line, a source connected to the drain of the first transistor, and a drain connected to the floating node;

a second capacitor comprising a third electrode connected to the floating node and a fourth electrode connected to the emission control line;

a fourth transistor comprising a gate connected to the second scan line, a source connected to the gate of the first transistor, and a drain connected to the voltage line;

a fifth transistor comprising a gate connected to the emission control line, a source connected to the power line, and a drain connected to the source of the first transistor;

a sixth transistor comprising a gate connected to the emission control line, a source connected to the drain of the first transistor, and a drain connected to the anode of the display element; and a seventh transistor comprising a gate connected to the third scan line, a source connected to the anode of the display element, and a drain connected to the voltage line.

15. The pixel of claim 14, wherein the third transistor turns off in response to a rising edge of the first scan signal, the fifth and sixth transistors turn on in response to a falling edge of the emission control signal, and a first potential change amount of the floating node in response to the rising edge of the first scan signal is at least partially offset by a second potential change amount of the floating node in response to the falling edge of the emission control signal.

16. The pixel of claim 14, wherein the third transistor turns off in response to a rising edge of the first scan signal, the fifth and sixth transistors turn on in response to a falling edge of the emission control signal, and a potential of the floating node rises by the rising edge of the first scan signal, and falls by the falling edge of the emission control signal.

17. The pixel of claim 14, wherein the fourth transistor comprises a first gate initialization transistor and a second gate initialization transistor, the first gate initialization transistor comprising a gate connected to the second scan line, a source connected to the gate of the first transistor, and a drain, and the second gate initialization transistor comprising a gate connected to the second scan line, a source connected to the drain of the first gate initialization transistor, and a drain connected to the voltage line.

18. A display apparatus comprising:

a substrate extending in a first direction and a second direction;

first and second scan lines which transfer first and second scan signals, respectively, and extend in the first direction;

a data line which transfers a data voltage and extending in the second direction;

an emission control line which transfers an emission control signal;

a power line which transfers a driving voltage; and a plurality of pixels arranged on the substrate in the first direction and the second direction, each of the plurality of pixels comprising:

a display element;

a driving transistor which controls an amount of a driving current flowing toward the display element according to a gate-source voltage of the driving transistor;

a first capacitor connected to a gate of the driving transistor;

a scan transistor which transfers a data voltage to a source of the driving transistor in response to the first scan signal;

first and second compensation transistors which operate in response to the first scan signal, and which are connected to each other in series between the gate and a drain of the driving transistor;

first and second emission control transistors which generate, in response to the emission control signal, a path of the driving current between the display element and the power line; and a second capacitor connected between a floating node between the first and second compensation transistors and a gate of the second emission control transistor.

19. The display apparatus of claim 18, wherein the first and second compensation transistors turn off in response to a rising edge of the first scan signal, the first and second emission control transistors turn on in response to a falling edge of the emission control signal, and a first potential change amount of the floating node in response to the rising edge of the first scan signal is at least partially offset by a second potential change amount of the floating node in response to the falling edge of the emission control signal.

20. The display apparatus of claim 18, wherein the first and second compensation transistors turn off in response to a rising edge of the first scan signal, the first and second emission control transistors turn on in response to a falling edge of the emission control signal, and an electric potential of the floating node rises by the rising edge of the first scan signal, and falls by the falling edge of the emission control signal.

* * * * *